US008665047B1

(12) United States Patent
Dively et al.

(10) Patent No.: US 8,665,047 B1
(45) Date of Patent: Mar. 4, 2014

(54) AIR-COOLED HIGH-EFFICIENCY TRANSFORMER SYSTEM

(71) Applicants: Robert C. Dively, Williamsburg, VA (US); Barry J. Sharp, Gloucester, VA (US)

(72) Inventors: Robert C. Dively, Williamsburg, VA (US); Barry J. Sharp, Gloucester, VA (US)

(73) Assignee: Marina Electrical Equipment, Inc., Williamsburg, VA (US)

( * ) Notice: Subject to any disclaimer, the term of this patent is extended or adjusted under 35 U.S.C. 154(b) by 0 days.

(21) Appl. No.: 13/729,146

(22) Filed: Dec. 28, 2012

(51) Int. Cl.

| | |
|---|---|
| ***H01F 27/08*** | (2006.01) |
| ***H01F 27/06*** | (2006.01) |
| ***H01F 27/02*** | (2006.01) |
| ***H01F 27/28*** | (2006.01) |
| ***H01F 27/30*** | (2006.01) |
| ***H01F 21/06*** | (2006.01) |

(52) U.S. Cl.
USPC ..... 336/61; 336/55; 336/65; 336/90; 336/229; 336/196; 336/130; 336/131

(58) Field of Classification Search
USPC ..... 336/61, 60, 55, 65, 90, 229, 196
See application file for complete search history.

(56) References Cited

U.S. PATENT DOCUMENTS

| | | | | |
|---|---|---|---|---|
| 5,448,215 | A * | 9/1995 | Sokai | 336/57 |
| 5,691,686 | A * | 11/1997 | Ishikawa et al. | 336/90 |
| 6,885,269 | B2 * | 4/2005 | Miettinen et al. | 336/65 |
| 8,284,006 | B2 * | 10/2012 | Bacarisse | 336/90 |
| 2003/0020581 | A1 * | 1/2003 | Carter et al. | 336/90 |
| 2009/0315657 | A1 * | 12/2009 | Hoffman et al. | 336/57 |
| 2011/0227682 | A1 * | 9/2011 | MacLennan | 336/57 |
| 2012/0262264 | A1 * | 10/2012 | Engelage et al. | 336/55 |

* cited by examiner

*Primary Examiner* — Elvin G Enad
*Assistant Examiner* — Kazi Hossain
(74) *Attorney, Agent, or Firm* — Peter J. Van Bergen

(57) ABSTRACT

A transformer system includes a cabinet and at least one toroidal transformer with each toroidal transformer being supported in a cradle. Each cradle is mounted in the cabinet and supports its toroidal transformer in a vertical or horizontal orientation such that a central air-filled region thereof is arranged in a substantially horizontal or vertical orientation, respectively. The cradle supports active and passive cooling arrangements for the toroidal transformer, while also providing modular attributes for the transformer system.

18 Claims, 12 Drawing Sheets

AIR-COOLED HIGH-EFFICIENCY TRANSFORMER SYSTEM

FIELD OF THE INVENTION

The invention relates generally to transformer systems, and more particularly to a high-efficiency transformer system utilizing an air cooling support system for toroidal core transformer(s).

BACKGROUND OF THE INVENTION

Large transformers on the order of 150 kVA or more are used in a wide variety of industrial and commercial applications. Regardless of the application, users of these transformers demand high efficiencies as even small improvements (i.e., less than one percent) in efficiency translate into thousands of dollars in energy savings.

In addition to the efficiency issues, large transformers generate a substantial amount of heat that can cause the premature failure of supporting electrical components (e.g., circuit breakers) if they are in proximity to the transformers. Accordingly, such supporting electrical components are typically separated from the transformers. In terms of large transformer systems, such separation is usually accomplished using multiple cabinets/housings with the transformer(s) located in one cabinet and the supporting electrical components located in another cabinet. However, the use of multiple cabinets/housings adds to fabrication, handling, and maintenance costs.

Many transformer systems are difficult or nearly impossible to repair on site thereby subjecting owners to high maintenance costs. Further, many transformer applications require the transformers to reside outside in the elements. For example, marinas use transformers to step down line voltage for supply to a number of power pedestals distributed about a marina. Thus, transformer cabinet design can be critical to the protection of the housed electrical components. Still further, transformer cabinet design must be economical in terms of cost, size, weight, etc., in order to make the overall transformer system affordable and manageable in terms of transportation, handling and site placement.

SUMMARY OF THE INVENTION

Accordingly, it is an object of the present invention to provide a transformer system.

Another object of the present invention is to provide a high-efficiency transformer system.

Still another object of the present invention is to provide a transformer system employing efficient and effective cooling.

Yet another object of the present invention is to provide a high-efficiency transformer system that can operate in harsh environments.

A further object of the present invention is to provide a high-efficiency transformer system that is economical in terms of cost, maintenance, size, and weight.

Other objects and advantages of the present invention will become more obvious hereinafter in the specification and drawings.

In accordance with the present invention, a transformer system includes a cabinet and at least one toroidal transformer with a central region thereof being filled with air. A cradle is provided for use with each toroidal transformer. Each cradle is mounted in the cabinet and supports a corresponding toroidal transformer in a vertical orientation and/or horizontal orientation such that the central air-filled region thereof is arranged in a substantially horizontal orientation and/or vertical orientation, respectively. The cradle supports active and passive cooling arrangements for the toroidal transformer, while also providing modular attributes for the transformer system.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

The present invention is a transformer system that includes one or more (i.e., ganged) toroidal transformers mounted in a cabinet such that the transformer(s) are efficiently air-cooled to thereby extend the life of the transformers and allow the transformer system to achieve lower fabrication, handling, and maintenance costs. Briefly, the transformer mounting used in the present invention is modular in nature thereby simplifying maintenance and minimizing downtime. The cabinet also provides substantial improvements in material usage and strength thereby providing weight and cost savings, while also providing a transformer system that can withstand the rigors of transportation and harsh-environment installations.

In order to clearly illustrate the novel features of the present invention, electrical wiring of the various embodiments has been omitted in FIGS. 1-12. However, as will be explained further below, the various electrical components (e.g., switches, relays, terminal bars, breakers, etc.) can be incorporated in the transformer system cabinet to reduce costs. It is to be understood that such wiring and electrical components would be included in a completed transformer system of the present invention.

Figure 1:
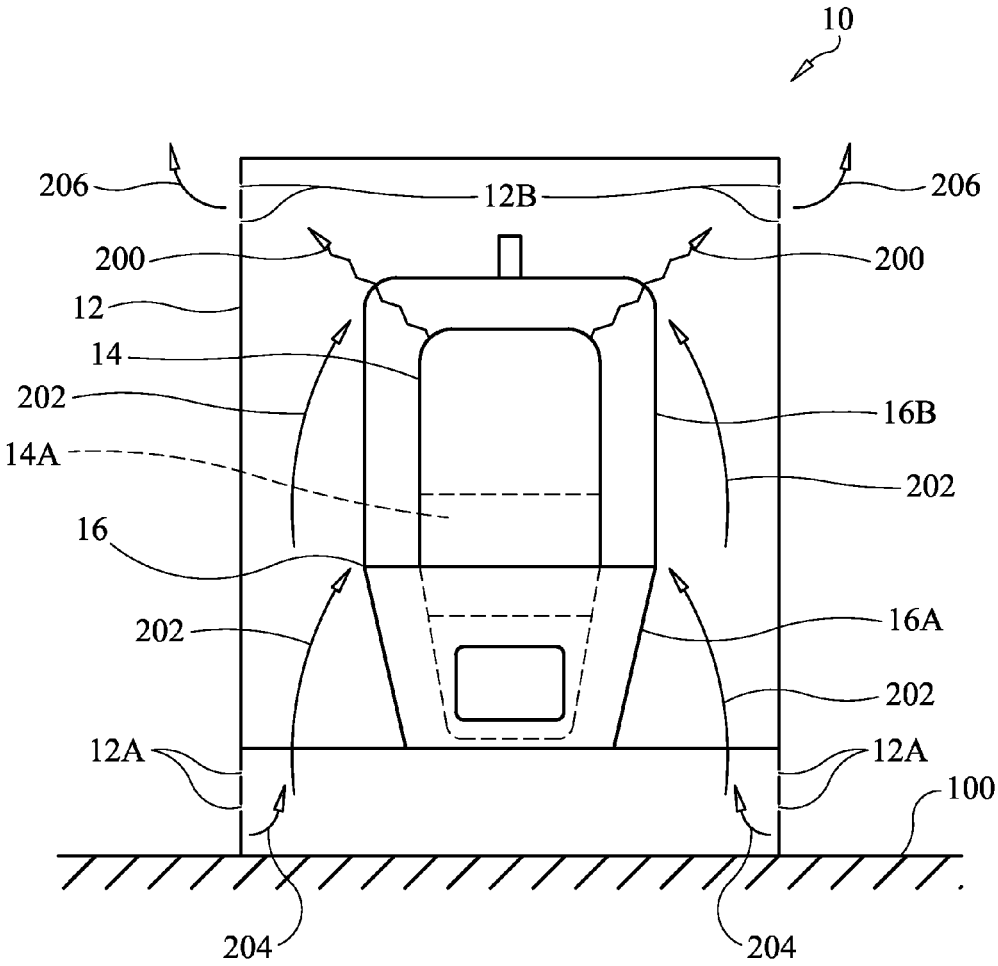
FIG. 1 is a schematic view of a transformer system in accordance with an embodiment of the present invention.

Referring now to FIG. 1, a transformer system in accordance with an embodiment of the present invention is shown and is referenced generally by numeral 10. In general, transformer system 10 includes a cabinet 12 (normally closed but shown open for purpose of the description), a toroidal transformer 14, and a cradle 16 that holds/supports transformer 14 in a vertical orientation within cabinet 12. More specifically, cabinet 12 supports transformer 14/cradle 16 at a position therein that will be above a surface 100 on which transformer system 10 is positioned, and cradle 16 supports/positions transformer 14 vertically such that its central air-filled region 14A is in a substantial horizontal orientation in cabinet 12.

The construction of toroidal transformers is known in the art. However, by way of example, a brief description will be provided of a manufacturing process used to make a high kVA transformer (e.g., on the order of 50 kVA) that can be used in transformer system 10. The process begins by winding a continuous strip of grain-oriented silicon steel onto a mandrel that defines the internal diameter of the transformer core. The strip is wound until the desired build and external diameter of the transformer core are achieved. The strip is then cut and tack welded, the mandrel is removed, and edges of the transformer core are chamfered. The transformer core is annealed to relieve stresses and restore the core material's original magnetic properties. The transformer core is wrapped with an insulating material prior to having the transformer's high voltage coil wound thereon. Insulating material is wound over the high voltage coil prior to the transformer's low voltage coil being wound thereon. Insulating material is wound over the low voltage coil. Electrical leads attached to the low and high voltage coils are made available outside of the final wrapping of insulating material. Additional or fewer processing steps could be used without departing from the scope of the present invention.

The structure of cradle 16 serves a variety of functions in transformer system 10. Specifically, cradle 16 positions toroidal transformer 14 in its vertical orientation, supports a cooling air flow in cabinet 12 as will be described further below, and facilitates handling and installation/removal of toroidal transformer 14 as a modular component of system 10. Referring additionally and simultaneously to FIGS. 2A-2E, an embodiment of cradle 16 that provides for all of these functions will be described.

Figure 2A:
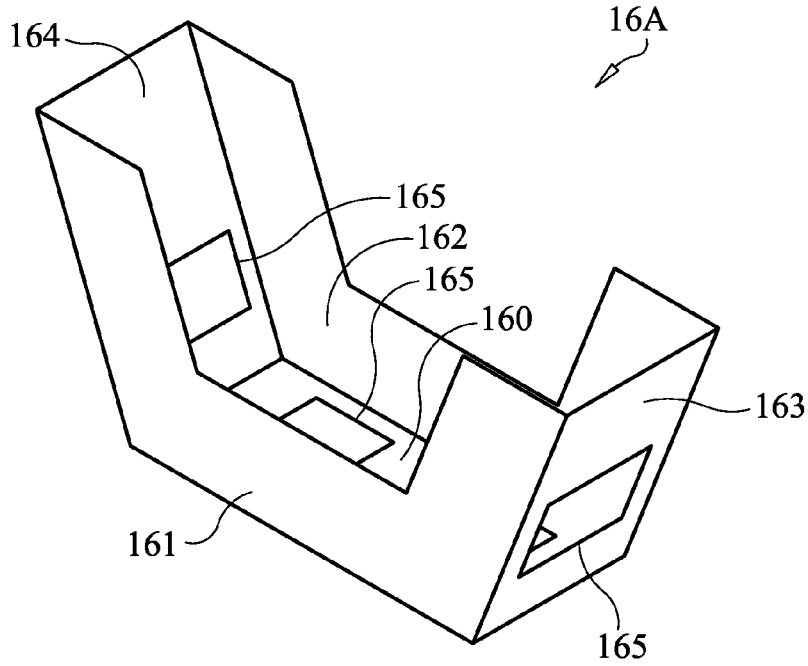
FIG. 2A is an isolated perspective view of the lower U-shaped portion of a cradle used in the transformer system in accordance with an embodiment of the present invention.
Figure 2B:
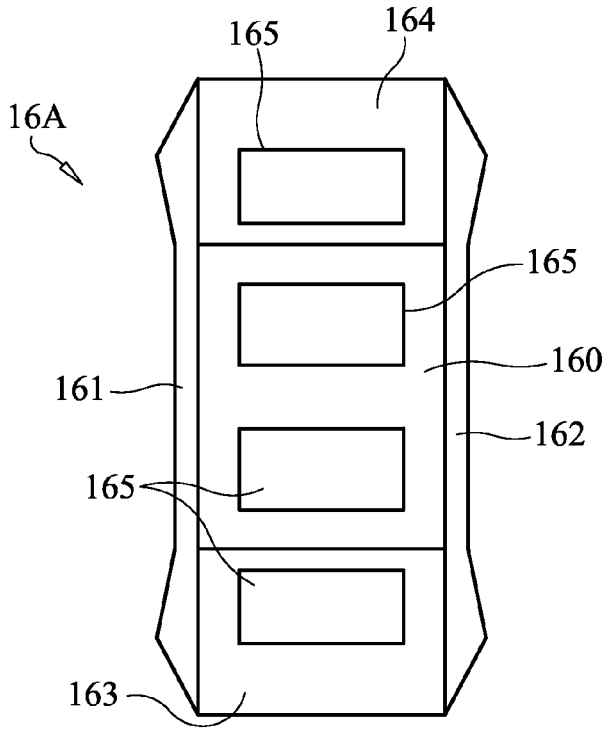
FIG. 2B is an isolated top view of the lower U-shaped portion of the cradle.
Figure 2C:
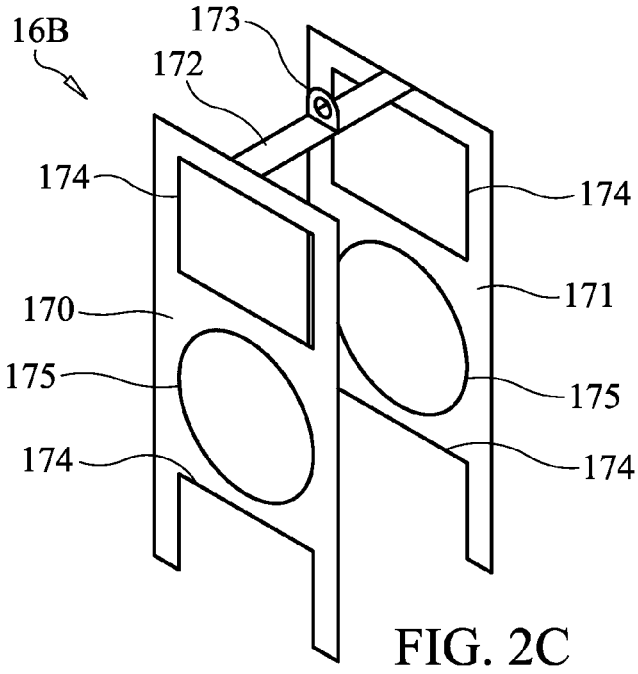
FIG. 2C is an isolated perspective view of the upper U-shaped portion of the cradle used in the transformer system in accordance with an embodiment of the present invention.
Figure 2D:
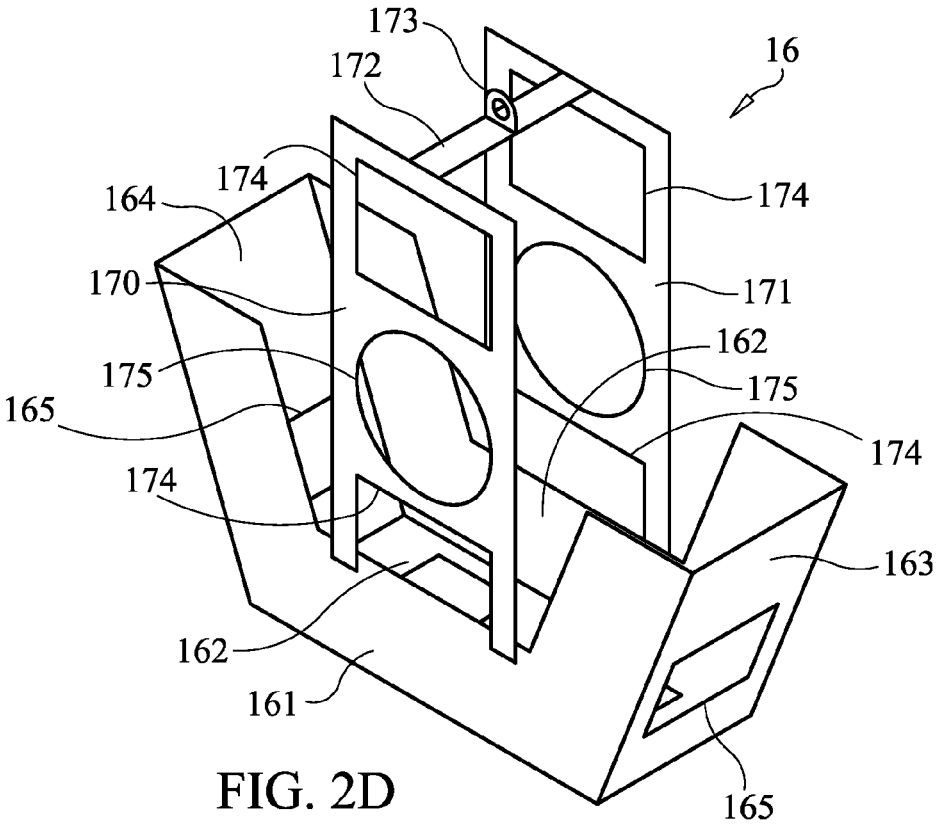
FIG. 2D is an isolated perspective view of a fully-assembled cradle in accordance with an embodiment of the present invention.
Figure 2E:
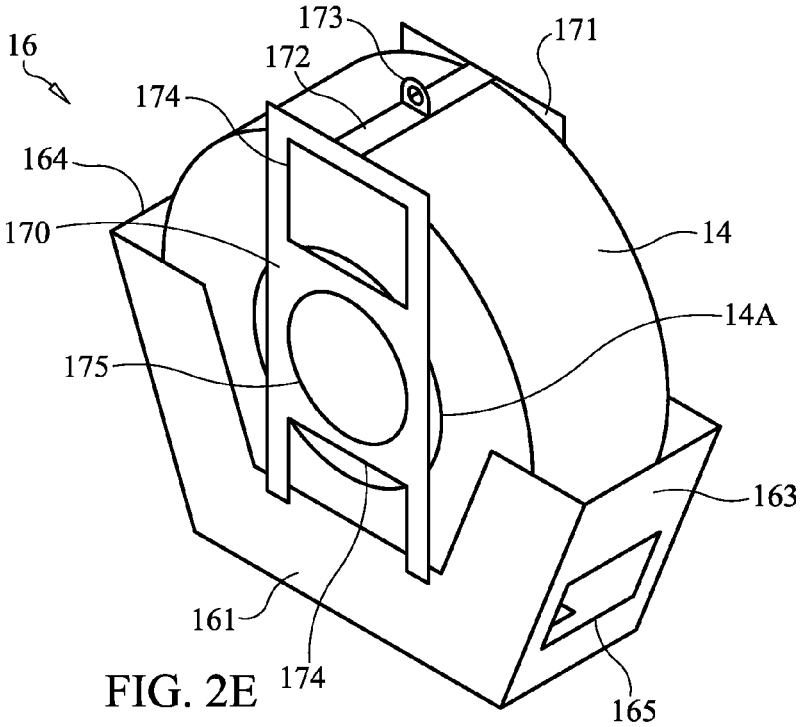
FIG. 2E is an isolated perspective view of a fully-assembled cradle with a toroidal transformer supported therein in accordance with an embodiment of the present invention.

Cradle 16 is an open framework assembly that includes a lower U-shaped portion 16A (FIGS. 2A and 2B) and an upper U-shaped portion 16B (FIG. 2C) that are assembled to define cradle 16 (FIG. 20) that supports a toroidal transformer 14 therein (FIG. 2E). In general, toroidal transformer 14 rests in lower U-shaped portion 16A while upper U-shaped portion 16B fits over transformer 14 and attaches to lower U-shaped portion 16A. More specifically, lower U-shaped portion 16A has a bottom 160, opposing sides 161 and 162 that flare out slightly from bottom 160 to facilitate the positioning of transformer 14 therein, and opposing ends 163 and 164 that flare away from one another to accommodate the diameter of transformer 14. That is, the lower half of transformer 14 rests in portion 16A. The height of lower U-shaped portion 16A is approximately equal to the radius of transformer 14. To facilitate air flow in and around the lower half of transformer 14, air flow holes 165 are provided in bottom 160 and ends 163/164.

Upper U-shaped portion 16B has sides 170 and 171 joined together at the tops thereof by a connector 172. Attached to the top of connector 172 is a lifting eye 173 that facilitates the lifting and handling of a cradle 16 and its supported transformer 14. To facilitate air flow around and through the upper regions of transformer 14, air flow holes 174 and 175 are provided in upper U-shaped portion 16B. As best illustrated in FIG. 2E, holes 174 are aligned with the solid portions of transformer 14, while holes 175 are aligned with the central air-filled region 14A of transformer 14.

Referring again to FIG. 1, as transformer 14 heats up during its operation, heat (represented by wavy arrows 200) produced thereby rises in cabinet 12. The rising heated air draws cooler air 202 upwards from the lower regions of cabinet 12. The above-described structure of cradle 16 supports the flow of the cooler air 202 around transformer 14 and through its central region 14A. Thus, transformer system 10 provides for the passive cooling of transformer 14. Such passive cooling can be further enhanced by the provision of openings/vents 12A in cabinet 12 below transformer 14, and the provision of openings/vents 12B in cabinet 12 above transformer 14. In this way, cooler ambient air flows into the lower portions of cabinet 12 at 204 while warmer air exits the upper portions of cabinet 12 at 206.

Figure 2F:
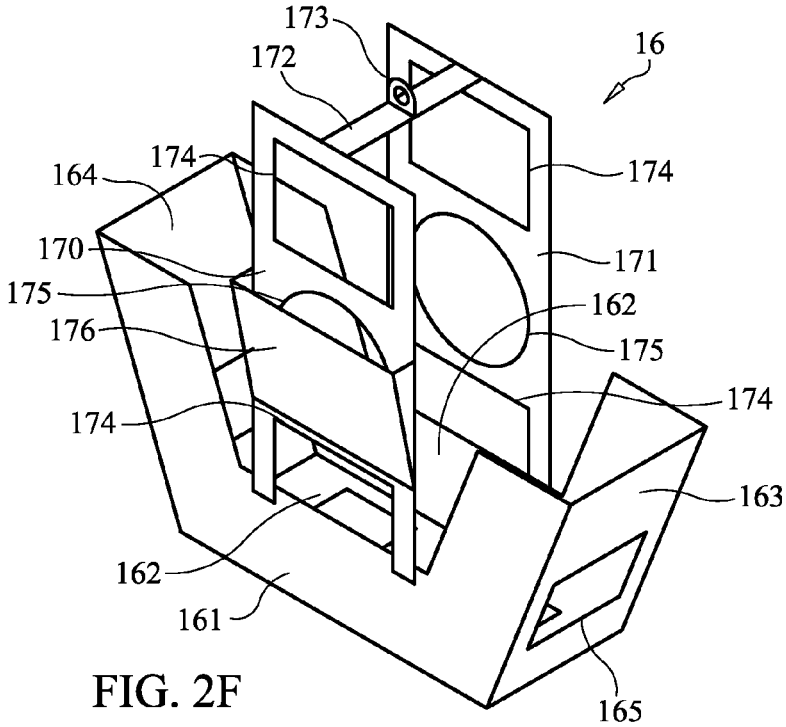
FIG. 2F is an isolated perspective view of a fully-assembled cradle to include an air deflector in accordance with another embodiment of the present invention.

The structure of cradle 16 also supports active cooling of transformer 14 supported therein. That is, an electric fan (not shown) can be attached to one of sides 170 or 171 adjacent to the corresponding hole 175 aligned with the central air-filled region of the transformer. As illustrated in FIG. 2F, cradle 16 can also include a deflector 176 attached/coupled to one of sides 170 or 171 adjacent to the corresponding hole 175 aligned with the central air-filled region of the transformer. Thus, with a fan positioned between side 170 or 171 and deflector 176 and with the fan being positioned/configured to draw air through the central region of the transformer, the drawn through air is directed upwards in the cabinet as will be explained further below.

Figure 3:
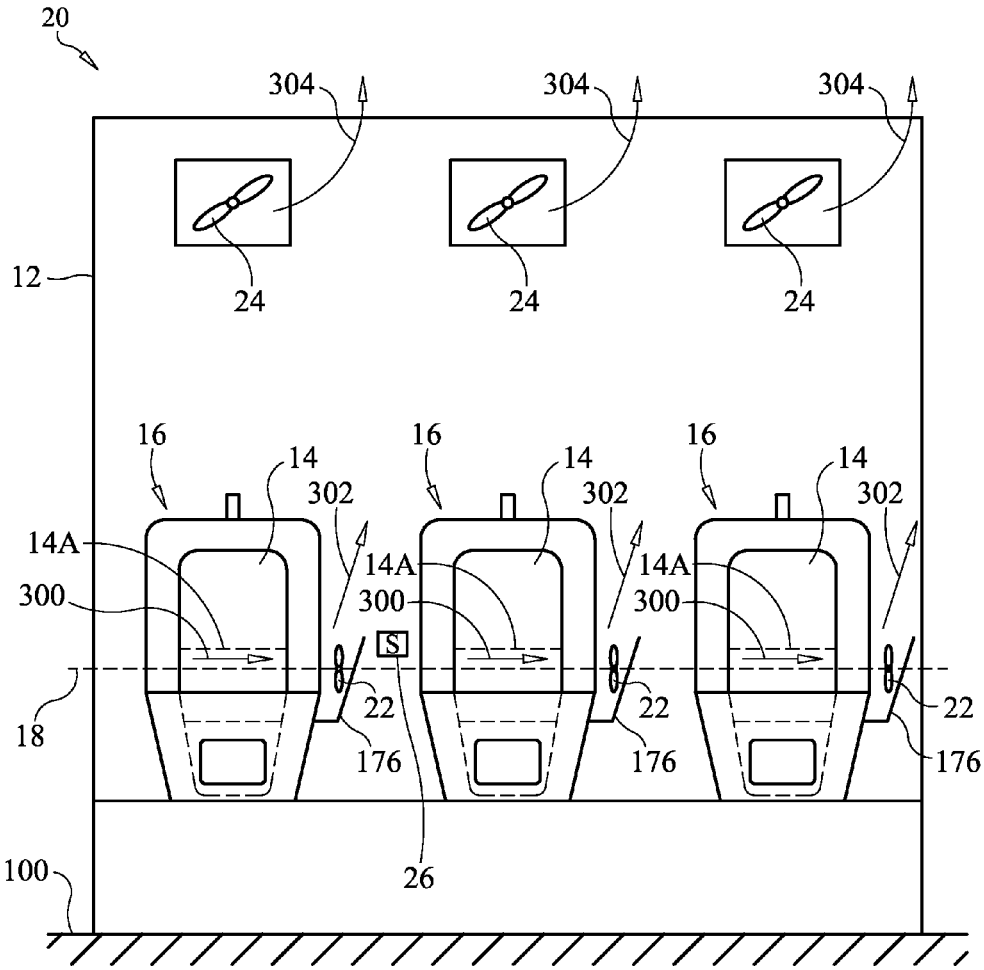
FIG. 3 is a schematic view of a transformer system that illustrates a ganged arrangement of toroidal transformers in accordance with another embodiment of the present invention.

Referring now to FIG. 3, a schematic view of a transformer system in accordance with another embodiment of the present invention is shown and is referenced generally by numeral 20. Transformer system 20 includes three cradles 16, each of which supports a corresponding toroidal transformer 14. Details of cradles 16 are the same as the already described above. Cradles 16 are positioned in cabinet 12 such that all central air-filled regions 14A are aligned along a common and substantially horizontal axis indicated by dashed line 18. An electric fan 22 (illustrated in a schematic fashion) is mounted to each cradle 16 and is configured to draw air through the corresponding central region 14A as indicated by flow arrows 300. With deflector 176 attached to each cradle 16 as described above, the air exiting each fan 22 is directed up into cabinet 12 as indicated by flow arrows 302. Mounted in a wall (or walls) of cabinet 12 are one or more electric fans 24 configured to expel air in cabinet 12 as indicate by flow arrows 304. Fans 22 and 24 can be configured to run continuously with operation of transformer system 20. However, electric efficiency of transformer system 20 can be further enhanced if fans 22 and 24 are only operated when temperatures in cabinet 12 increase above an acceptable level. Accordingly, a temperature sensor ("S") 26 (or multiple temperature sensors) is positioned in cabinet 12 to monitor temperature therein. Since central regions 14A represent the most enclosed portions of each transformer 14, sensor 26 can be positioned at/near one central region 14A as illustrated. The signal generated by temperature sensor 26 can be provided to a controller (not shown) to govern the on/off operation of fans 22 and 24. Such control would be well understood in the art and will not be detailed herein.

Figure 4:
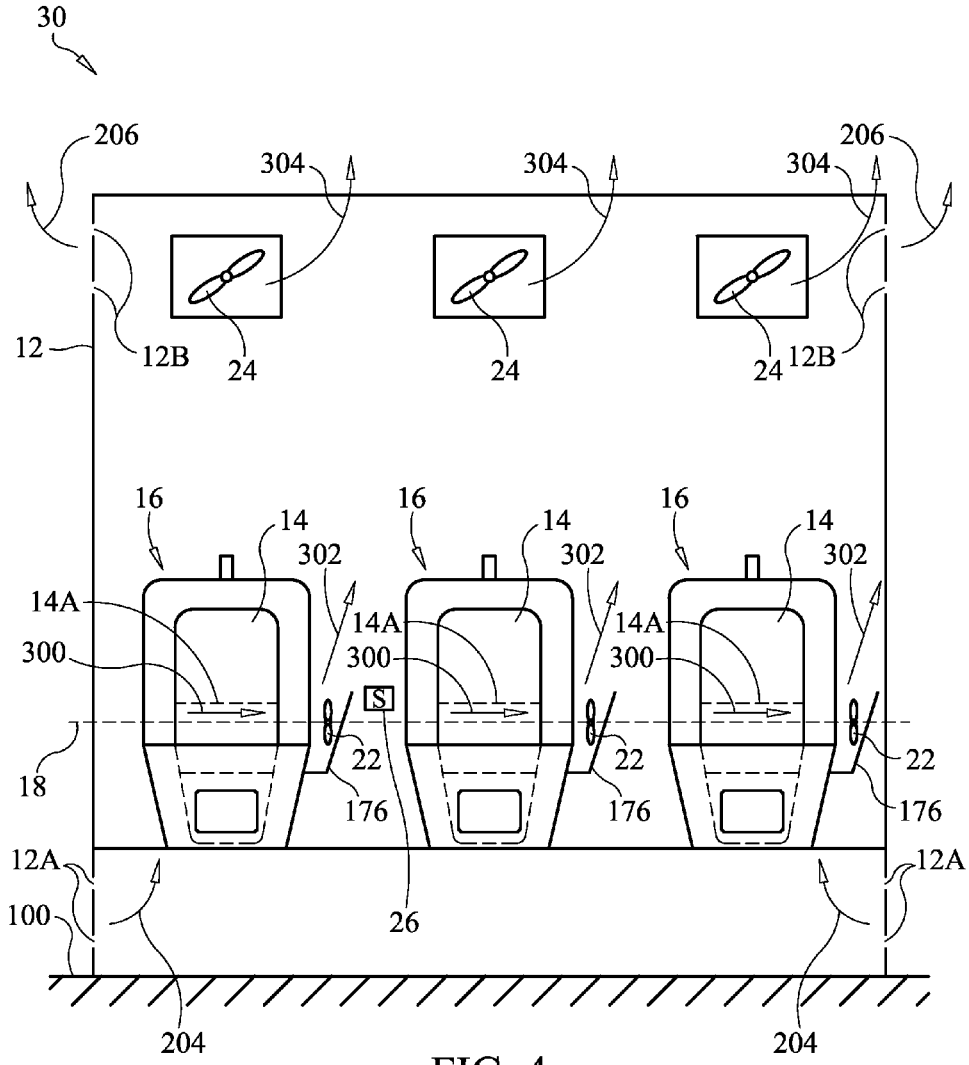
FIG. 4 is a schematic view of a transformer system in accordance with yet another embodiment of the present invention.

Another embodiment of the present invention is illustrated in FIG. 4 where a transformer system 30 is configured like transformer system 20 with the additional provisions of cabinet openings/vents 12A below transformers 14, and cabinet openings/vents 12B above transformers 14. In this way, transformer system 30 combines passive and active cooling attributes.

As mentioned above, cabinet 12 can be configured to support the present invention's air-cooling function while also providing substantial improvements in terms of cost, weight and strength as compared to conventional transformer cabinets. By way of example, an embodiment of cabinet 12 that provides strength at a reduced cost/weight will be described with reference to FIGS. 5-11. The four main parts/assemblies of cabinet 12 are its frame or skeleton (FIG. 5), roof (FIG. 6), side panels (FIG. 7), and door (FIG. 8).

Figure 5:
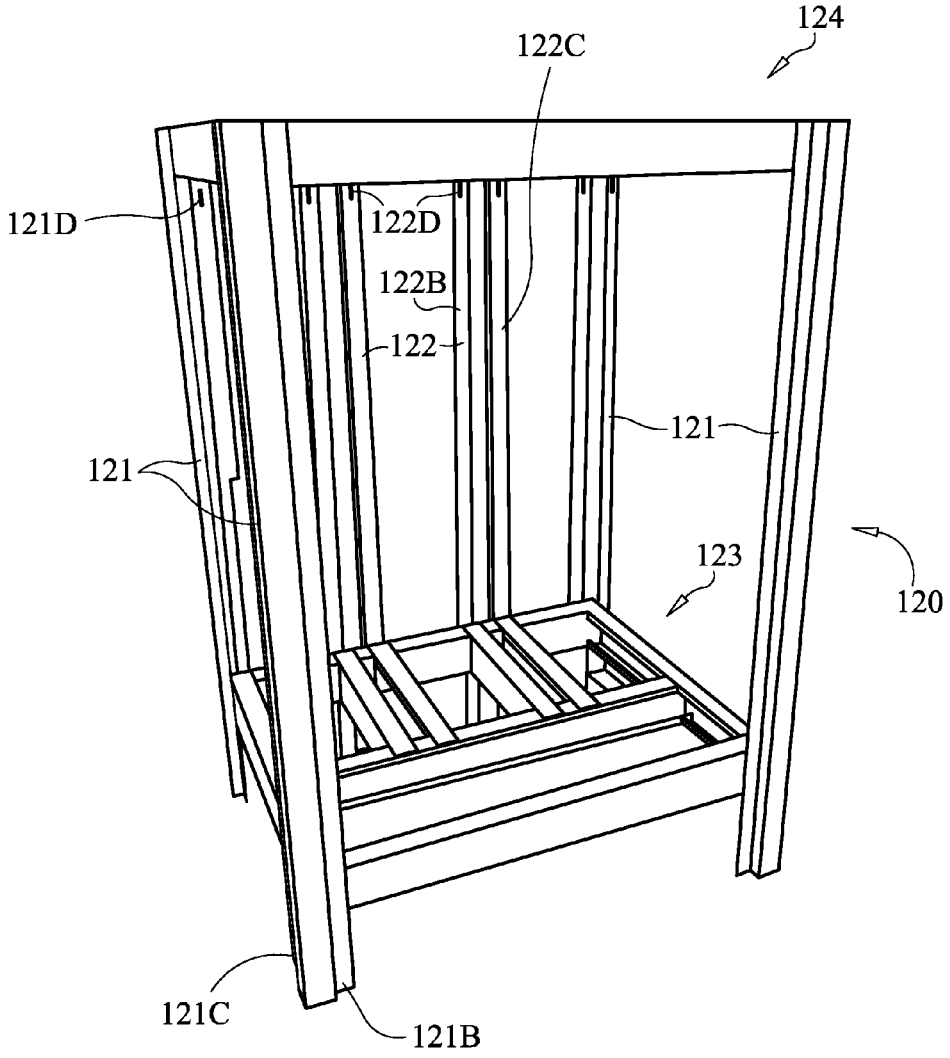
FIG. 5 is an isolated perspective view of a frame for the transformer system's cabinet in accordance with an embodiment of the present invention.
Figure 6:
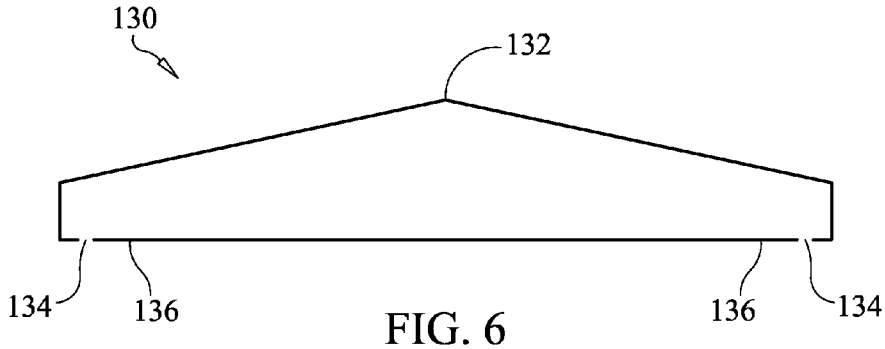
FIG. 6 is an isolated side view of a roof for the transformer system's cabinet in accordance with an embodiment of the present invention.

Referring first to FIG. 5, a frame 120 for cabinet 12 includes corner posts 121, side posts 122, a lower horizontal arrangement 123 of struts that serves as the mounting "floor" for the cradle/transformer assemblies described above, and an upper horizontal arrangement 124 of struts. Lower arrangement 123 and upper arrangement 124 tie corner posts 121 and side posts 122 together. Each of corner posts 121 (illustrated in cross-section in FIG. 9) is made from a single piece of bent metal (e.g., steel) to define a substantially rectangular post open at one corner thereof as indicated by numeral 121A. Flanges 121B and 121C extend from open corner 121A and are arranged at a right angle with respect to one another. Slots 121D can be provided in flanges 121B/121C (FIG. 5) to facilitate installation of side panels. Each of side posts 122 (illustrated in cross-section in FIG. 10) is made from a single piece of bent metal (e.g., steel) to define three-quarters of a rectangle 122A with side flanges 122B/122C aligned with one another and extending in opposing directions as shown. Slots 122D can be provided in flanges 122B/122C (FIG. 5) to facilitate installation of side panels. Each of the struts used to construct lower arrangement 123 and upper arrangement 124 (illustrated in cross-section in FIG. 11 and referenced generally by numeral 126) is a single piece of bent metal (e.g., steel) that is substantially C-shaped in cross-section.

Roof 130 can be made from a single piece of bent metal to define a crown 132 to facilitate moisture run off. Vents or openings 134 can be provided in the underside lip region 136 of roof 130 such that, when roof 130 is attached to posts 120/121 and/or side panels 140 (FIG. 7), the air inside the upper regions of cabinet 12 are in fluid communication with ambient air outside of cabinet 12.

Figure 7:
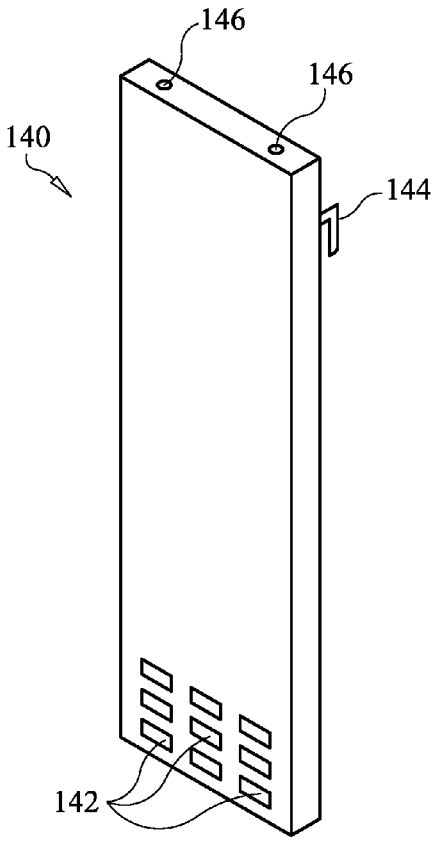
FIG. 7 is an isolated perspective view of a side panel for the transformer system's cabinet in accordance with an embodiment of the present invention.
Figure 8:
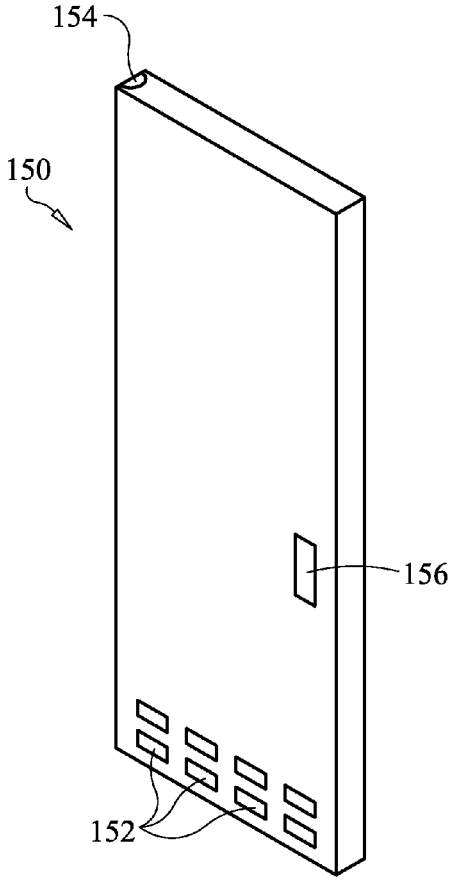
FIG. 8 is an isolated perspective view of a door for the transformer system's cabinet in accordance with an embodiment of the present invention.
Figure 9:
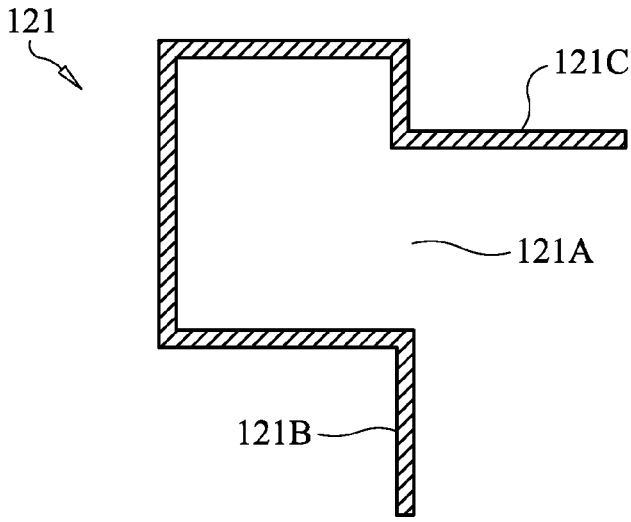
FIG. 9 is a cross-sectional view of a corner post used in the construction of the cabinet frame in accordance with an embodiment of the present invention.
Figure 10:
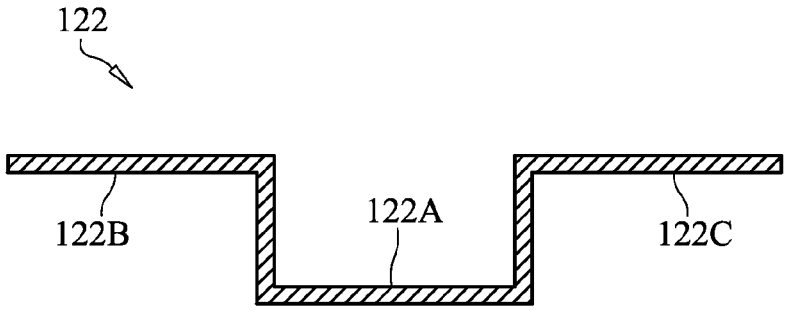
FIG. 10 is a cross-sectional view of a side post used in the construction of the cabinet frame in accordance with an embodiment of the present invention.
Figure 11:
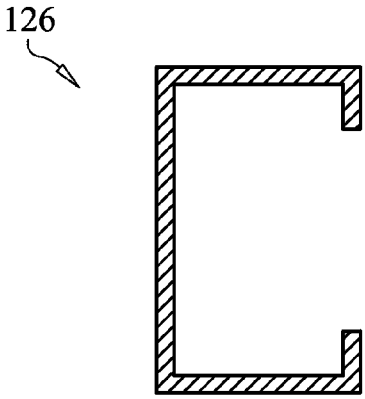
FIG. 11 is a cross-sectional view of a strut.

The side panels (one of which is illustrated in FIG. 7 and referenced by numeral 140) can be made from a single piece of bent metal. Vents/openings 142 can be provided in the lower portion of panel 140 to facilitate fluid communication between outside ambient air and the air inside cabinet 12, i.e., analogous to cabinet openings/vents 12A described above. Each side panel 140 can also define hooks 144 (one is visible in FIG. 7) that will cooperate with slots 121D or 122D of posts 121 and 122, respectively. Screw holes 146 can be provided in the top of panel 140 to facilitate attachment of roof 130.

Door 150 is configured similar to side panel 140 in that it can incorporate openings/vents 152 in the lower portion thereof. A hinge 154 can be provided to cooperate with one side door 150 and a latch 156 can be provided at the opposing side of door 150. Such hinge and latch constructions are not limitations of the present invention.

Figure 12:
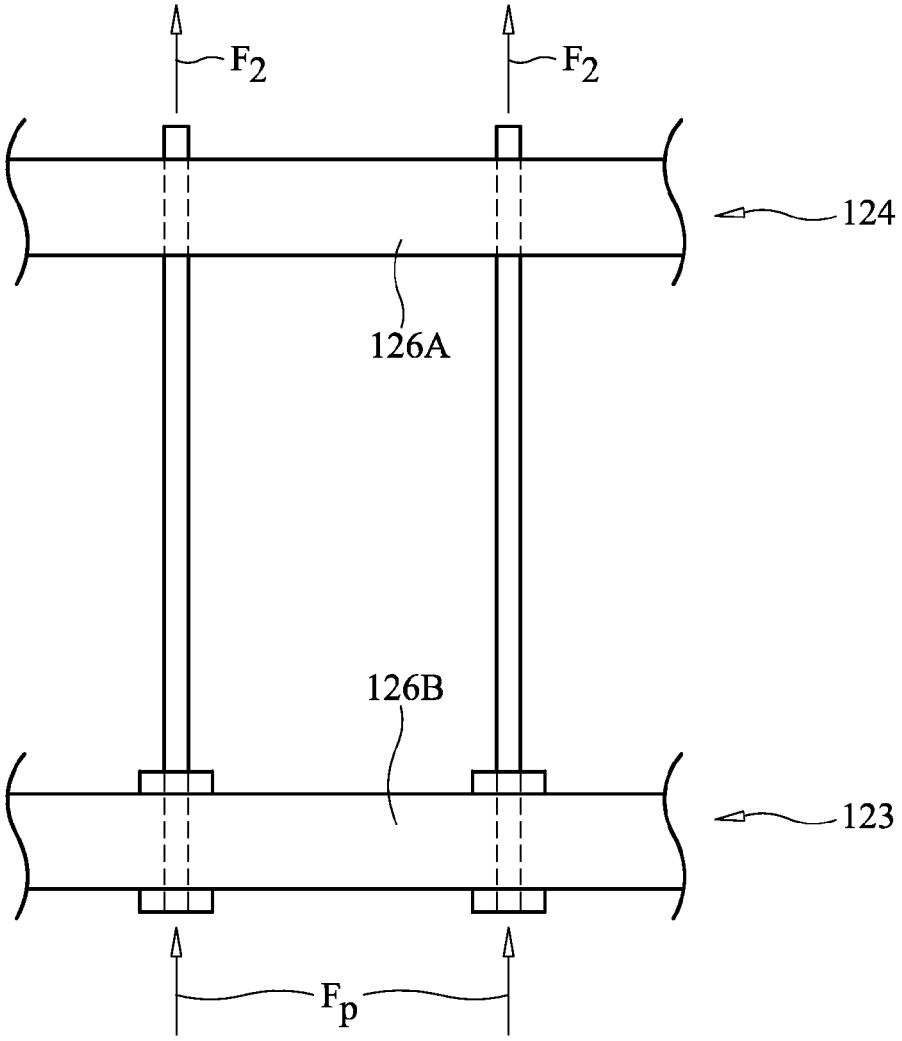
FIG. 12 is a side view of centrally-positioned upper and lower struts from the frame with lifting-load transfer rods coupled thereto in accordance with an embodiment to the present invention.

For transformer systems of the present invention that include ganged arrangements of high kVA toroidal transformers, weight of the overall system and cabinet integrity during handling are important issues. Since large transformer systems are typically hoisted into position via a crane, the present invention presents a novel load transfer approach that transfers a lifting force from above the transformer system's cabinet to underneath the cabinet to thereby minimize cabinet stresses. Referring to FIG. 12, a side view of a portion of the cabinet's upper arrangement 124 and lower arrangement 123 is shown. More specifically, centrally positioned and vertically aligned struts 126A and 126B from upper arrangement 124 and lower arrangement 123, respectively, are shown. One or more rigid rods (e.g., two are shown) 160 pass through upper strut 126A and lower strut 126B. Rods 160 are not fixed to upper strut 126A, but are fixed to lower strut 126B using an attachment mechanism 162. In this way, when a lifting force $F_L$ is applied to the tops of rods 160 (e.g., via a crane), the force is transferred to lower strut 126B to thereby lift up thereon as indicated by force arrows $F_P$. It is to be understood that other or additional structures can be provided on upper strut 126A to facilitate the transfer of a lifting force into rods 160. For example, reinforcing plates can be provided on either side of upper strut 126A and a pivoting "hook" could be coupled thereto near each of rods 160 such that the hook collapsed below the top of upper strut 126A when not in use.

Figure 13:
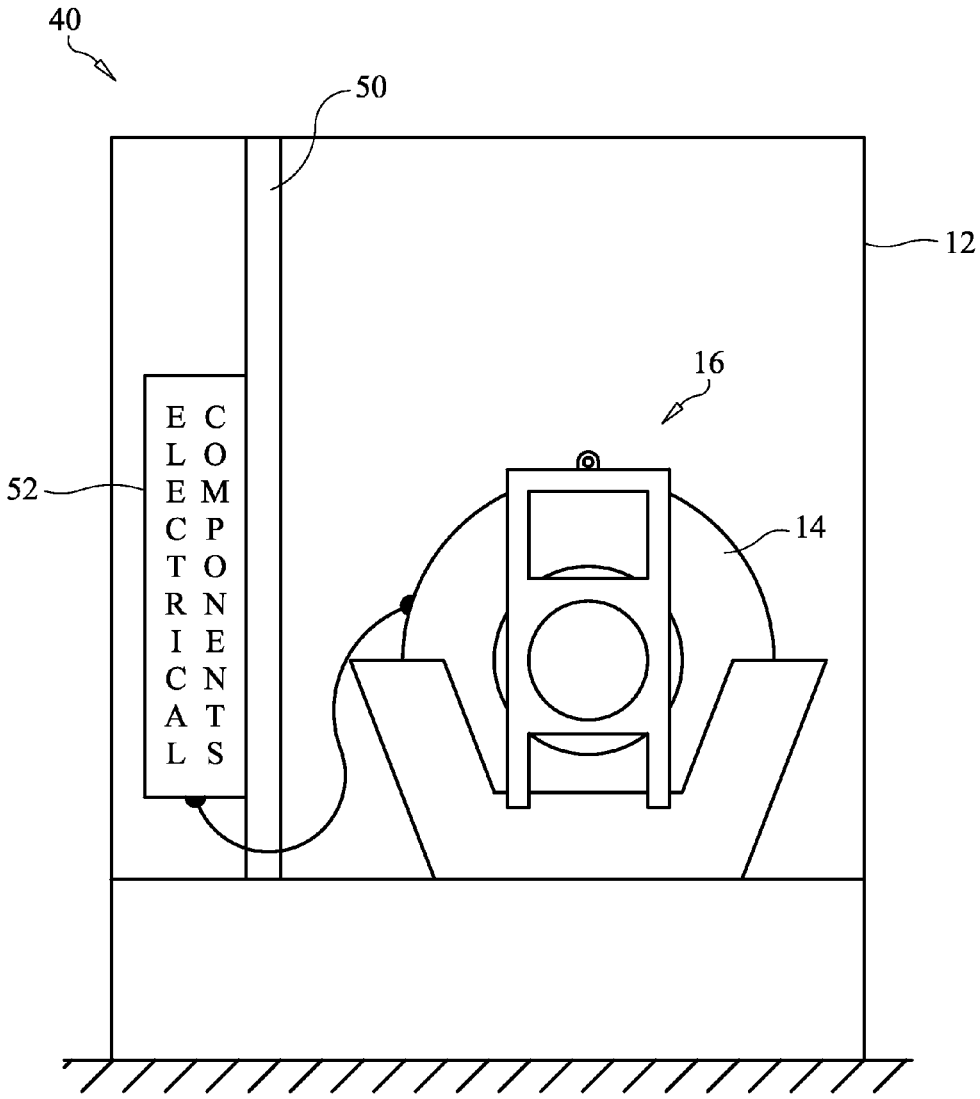
FIG. 13 is a schematic side view of a transformer system in accordance with another embodiment of the present invention in which supporting electrical components to include circuit breaker panels are housed in the same cabinet as the transformer(s)

The advantages of the present invention are numerous. The transformer system's unique toroidal transformer cradle positions the transformer for optimal passive and, if desired, active cooling. The improved cooling will extend the life of the transformer(s). Further, since the temperature in the transformer cabinet will be kept low, lower-cost insulating materials can be used. In addition, lower in-cabinet temperatures permit the use of an in-cabinet mounting scheme for supporting electronics (e.g., switches, relays, terminal bars, breakers, etc.). Accordingly, FIG. 13 illustrates a side view of a transformer system 40 (configured as one of previously-described transformer systems 10, 20 or 30) that also includes a mounting bracket 50 with transformer-supporting electrical components 52 (e.g., circuit breaker panels, etc.) mounted thereon. Electrical components 52 are electrically coupled to transformer(s) 14 in ways well understood in the art. Bracket 50/components 52 can be coupled to cabinet 12 and positioned adjacent to the door (not shown) of cabinet 12 to simplify access thereto.

The cradle of the present invention also improves transformer handling, adds a modular attribute to simplify maintenance and repair, and supports transformer cooling. The transformer system cabinet contributes to passive and active cooling of the system's transformers. The open post-and-strut cabinet frame keeps cabinet weight down while providing strength needed to pass strict force and handling tests. The cabinet can also incorporate load-transfer rod(s) that essentially transfer an upward-lifting force to the cabinet frame thereby minimizing stresses on the cabinet.

Figure 14:
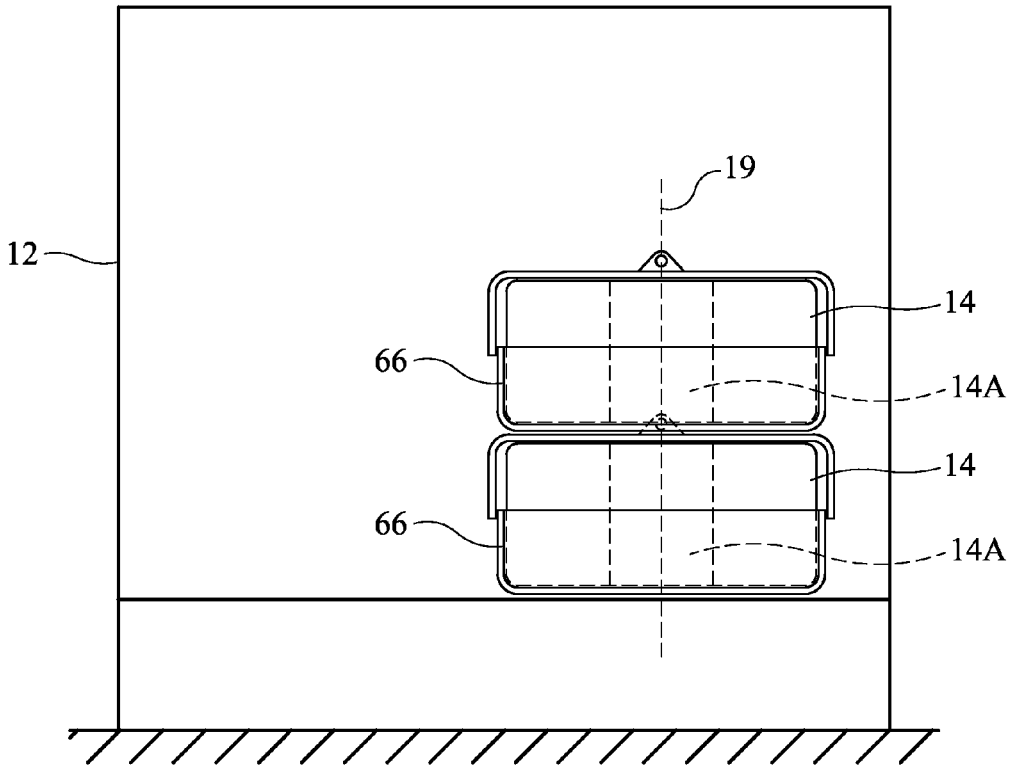
FIG. 14 is a schematic view of a transformer system that illustrates a ganged arrangement of horizontally-oriented toroidal transformers in accordance with another embodiment of the present invention.

Although the invention has been described relative to a specific embodiment thereof, there are numerous variations and modifications that will be readily apparent to those skilled in the art in light of the above teachings. For example, cradles used in the present invention can be configured for the horizontal orientation of the toroidal transformers. In such embodiments (one of which is illustrated schematically in FIG. 14), multiple horizontally-oriented toroidal transformers 14 are positioned in a cabinet 12 using supporting open framework cradles 66. Generally, each of cradles 66 will be supported and/or coupled to internal support structure(s) (not shown for clarity of illustration) of cabinet 12. Toroidal transformers 14 in cradles 66 are arranged in cabinet 12 such that the central air-filled regions 14A of transformers 14 are aligned along a common and substantially vertical axis as indicated by dashed line 19. A transformer system of the present invention could also include a combination of vertically and horizontally-oriented toroidal transformers without departing from the scope of the present invention. It is therefore to be understood that, within the scope of the appended claims, the invention may be practiced other than as specifically described.

What is claimed as new and desired to be secured by Letters Patent of the United States is:

1. A transformer system, comprising:

a cabinet;

at least one toroidal transformer with a central region thereof filled with air;

at least one cradle mounted in said cabinet, each said cradle supporting a corresponding one said toroidal transformer in a vertical orientation wherein said central region thereof is arranged in a substantially horizontal orientation, each said cradle including a deflector positioned adjacent to said central region of said corresponding one said toroidal transformer for deflecting air impinging on said deflector upwards in said cabinet; and a fan coupled to each said cradle for drawing air through said central region for impingement on said deflector and subsequent upward movement in said cabinet.

2. A transformer system as in claim 1, further comprising at least one cabinet fan mounted in a wall of said cabinet for expelling air from within said cabinet.

3. A transformer system as in claim 2, wherein each said cabinet fan is positioned above each said toroidal transformer.

4. A transformer system as in claim 1, wherein said cabinet incorporates first openings in fluid communication with ambient air positioned below each said toroidal transformer and second openings in fluid communication with ambient air positioned above each said toroidal transformer.

5. A transformer system as in claim 1, wherein each said cradle comprises:

an upwardly-facing U-shaped portion for support of said corresponding one said toroidal transformer; and a downwardly-facing U-shaped portion coupled to said upwardly-facing U-shaped portion and extending over said corresponding one said toroidal transformer.

6. A transformer system as in claim 1, wherein said cabinet comprises:

a skeletal frame including posts held in a vertical orientation by a first horizontal arrangement of struts and a second horizontal arrangement of struts, said first horizontal arrangement of struts located at a top of said cabinet, said second horizontal arrangement of struts located in a lower half of said cabinet and forming a base for support of said cradle;

a plurality of panels attached to said posts;

a roof attached to at least one of said posts and said panels above said first horizontal arrangement of struts; and at least one door attached to at least one of said posts in a hinged fashion.

7. A transformer system as in claim 6, further comprising at least one rod having one end passing freely through one strut from said first horizontal arrangement of struts, said rod fixed to one strut from said second horizontal arrangement of struts, wherein a lifting force applied to said one end of said rod from above said first horizontal arrangement of struts is transferred to said one strut from said second horizontal arrangement of struts.

8. A transformer system as in claim 1, further comprising electrical components mounted in said cabinet for supporting operation of said at least one toroidal transformer.

9. A transformer system, comprising:

a cabinet;

a plurality of toroidal transformers, each of said toroidal transformers defining a central region filled with air;

a plurality of cradles mounted in said cabinet, each of said cradles supporting a corresponding one of said toroidal transformers in a vertical orientation wherein said central region from each said corresponding one of said toroidal transformers is aligned along a common and substantially horizontal axis, each of said cradles including a deflector positioned adjacent to said central region of said corresponding one of said toroidal transformers associated therewith for deflecting air impinging on said deflector upwards in said cabinet;

a transformer fan coupled to each said cradle for drawing air through said central region of said corresponding one of said toroidal transformers associated therewith for impingement on said deflector and subsequent upward movement in said cabinet;

at least one cabinet fan mounted in a wall of said cabinet for expelling air from within said cabinet;

said cabinet including a skeletal frame of posts held in a vertical orientation by a first horizontal arrangement of struts and a second horizontal arrangement of struts, said first horizontal arrangement of struts located at a top of said cabinet, said second horizontal arrangement of struts located in a lower half of said cabinet and forming a base for support of said cradles; and at least one rod having one end passing freely through one strut from said first horizontal arrangement of struts, said rod fixed to one strut from said second horizontal arrangement of struts, wherein a lifting force applied to said one end of said rod from above said first horizontal arrangement of struts is transferred to said one strut from said second horizontal arrangement of struts.

10. A transformer system as in claim 9, wherein said cabinet incorporates first openings in fluid communication with ambient air positioned below said toroidal transformers and second openings in fluid communication with ambient air positioned above said toroidal transformers.

11. A transformer system as in claim 9, wherein each said cabinet fan is positioned above said toroidal transformers.

12. A transformer system as in claim 9, further comprising a temperature sensor mounted in said cabinet for generating a control signal used to control operation of each said transformer fan and each said cabinet fan based on a temperature in said cabinet.

13. A transformer system as in claim 9, wherein each of said cradles comprises:

an upwardly-facing U-shaped portion for support of said corresponding one of said toroidal transformers associated therewith; and a downwardly-facing U-shaped portion incorporating said fan support, said downwardly-facing U-shaped portion coupled to said upwardly-facing U-shaped portion and extending over said corresponding one of said toroidal transformers associated therewith.

14. A transformer system as in claim 9, further comprising electrical components mounted in said cabinet for supporting operation of said at least one toroidal transformer.

15. A transformer system, comprising:

a cabinet;

a plurality of toroidal transformers, each of said toroidal transformers defining a central region filled with air;

a plurality of cradles mounted in said cabinet, each of said cradles supporting a corresponding one of said toroidal transformers in a vertical orientation wherein said central region from each said corresponding one of said toroidal transformers is aligned along a common and substantially horizontal axis, each of said cradles defined by an open framework construction that includes (i) an upwardly-facing U-shaped portion for support of said corresponding one of said toroidal transformers associated therewith, (ii) a downwardly-facing U-shaped portion coupled to said upwardly-facing U-shaped portion and extending over said corresponding one of said toroidal transformers associated therewith, and (iii) a deflector coupled to said downwardly-facing U-shaped portion and positioned adjacent to said central region of said corresponding one of said toroidal transformers for directing air impinging on said deflector upward in said cabinet;

a transformer fan coupled to each said downwardly facing U-shaped portion for drawing air in said cabinet through said central region of said corresponding one of said toroidal transformers associated therewith, wherein the air drawn through said central region impinges on said deflector and is directed upward in said cabinet;

at least one cabinet fan mounted in a wall of said cabinet above said toroidal transformers for expelling air from within said cabinet;

said cabinet including a skeletal frame of posts held in a vertical orientation by a first horizontal arrangement of struts and a second horizontal arrangement of struts, said first horizontal arrangement of struts located at a top of said cabinet, said second horizontal arrangement of struts located in a lower half of said cabinet and forming a base for support of said cradles; and at least one rod having one end passing freely through one strut from said first horizontal arrangement of struts, said rod fixed to one strut from said second horizontal arrangement of struts, wherein a lifting force applied to said one end of said rod from above said first horizontal arrangement of struts is transferred to said one strut from said second horizontal arrangement of struts.

16. A transformer system as in claim 15, wherein said cabinet incorporates first openings in fluid communication with ambient air positioned below said toroidal transformers and second openings in fluid communication with ambient air positioned above said toroidal transformers.

17. A transformer system as in claim 15, further comprising a temperature sensor mounted in said cabinet for generating a control signal used to control operation of each said transformer fan and each said cabinet fan based on a temperature in said cabinet.

18. A transformer system as in claim 15, further comprising electrical components mounted in said cabinet for supporting operation of said at least one toroidal transformer.

* * * * *